United States Patent [19]

Tanigawa et al.

[11] Patent Number: 4,741,394

[45] Date of Patent: May 3, 1988

[54] RADIATOR FOR MOTOR CARS

[75] Inventors: Toru Tanigawa; Shoji Shiga; Kiichi Akasaka; Yoshimasa Oyama, all of Nikko, Japan

[73] Assignees: The Furukawa Electric Co., Ltd., Tokyo; Nippondenso Co., Ltd., Kariya, both of Japan

[21] Appl. No.: 895,465

[22] Filed: Aug. 11, 1986

[51] Int. Cl.[4] ..... F28D 1/02

[52] U.S. Cl. ..... 165/153; 165/173; 165/905; 420/476; 420/477

[58] Field of Search ..... 165/133, 152, 905, 173, 165/153; 420/477, 490, 476

[56] References Cited

U.S. PATENT DOCUMENTS

| | | | |
|---|---|---|---|
| 3,913,444 | 10/1975 | Otti | 420/477 X |
| 3,939,908 | 2/1976 | Chartet | 165/152 X |
| 4,094,671 | 6/1978 | Hayashi | 420/477 |
| 4,366,117 | 12/1982 | Tsuji | 420/490 X |
| 4,642,146 | 2/1987 | Ashok et al. | 420/477 X |

*Primary Examiner*—Albert W. Davis, Jr.
*Assistant Examiner*—Peggy A. Neils
*Attorney, Agent, or Firm*—Oblon, Fisher, Spivak, McClelland & Maier

[57] ABSTRACT

In a radiator for motor cars wherein fins are fitted between vertical tubes through which the heat-exchanging medium flows to form a core and tube plates are provided at both ends of the tubes of said core to connect with a resinous tank, a concave groove is formed outside the peripheral portion thereof, and an elastic seal member is provided in said concave groove to insert the open end of the resinous tank, the improvement wherein said tube plates are α brass containing 15–38 wt. % Zn, 0.05–1.5 wt. % Si, and the remainder Cu.

7 Claims, 1 Drawing Sheet

RADIATOR FOR MOTOR CARS

BACKGROUND OF THE INVENTION

The present invention relates to a radiator for motor cars and its objective is to prevent the stress and corrosion crackings of the resinous radiator to improve its reliability in an economical manner.

In general, the radiator for motor cars is one for cooling the engine section. The cooling is carried therein out by allowing the heat-exchanging medium, for example, water or an anti-freeze fluid wherein glycol or glycol ether is added to water, to circulate between the radiator and the engine section and allowing the anti-freeze medium, whose temperature increases at the engine section, to heat-exchange with outside air in the radiator. Usually, the radiator is constructed, as shown in FIG. 1, in such a way that corrugated fins (2) made of copper are fitted by brazing between many brass tubes (1), through which the medium passes, to form a core (3), the brass tube plates (4) and (4') are provided at both ends of the tubes (1) of said core (3), and the open ends of the brass tanks (5) and (5') are fitted by brazing to said tube plates (4) and (4').

However, in order to lighten the car, a resinous radiator has been used. For example, as shown in FIG. 2, the peripheral portion of the tube plates (4) and (4') is bent to form a concave groove (6) opening to the outside, an elastic seal member (7) is provided in said concave groove (6) to insert the flange portion (5*a*) of the resinous tank (5), and the upper portion of the outer side (8) of the concave groove (6) is bent inwards to securely attache the tank.

Usually, for the tank, reinforced plastics, such as nylon filled with glass fibers etc., are used, and, for the tube plate, $\alpha$ brass plate (thickness: 0.5–1.2 mm) containing 30 to 35 wt. % Zn is used. The $\alpha$ brass has excellent strength and a good workability and is known as the most inexpensive alloy. However, with a resinous radiator cracking occurs starting from the inner portion during use. The cracking occurs mainly at the bottom portion of the concave groove and becomes pronounced particularly when the tube plate is made thin in order to lighten the car.

It has been known that the aforementioned cracking is a kind of stress and corrosion cracking (hereinafter abbreviated as SCC) and occurs as a brittle fracture along the particle boundary of brass, and that, though SCC is said to be caused usually with ammonia, even with the anti-freeze medium, in particular, the medium deficient in the component of rust inhibitor or general water for use, SCC becomes active due to the high temperature condition at the time of the running of radiator. SCC in a radiator using a resinous tank has been prevented and its reliability has been improved by the practice of this invention.

SUMMARY OF THE INVENTION

The invention is characterized in that, in the radiator wherein fins are fitted between many vertical tubes through which the heat-exchanging medium flows to form a core and tube plates are provided at both ends of the tubes of said core to connect with a resinous tank, a concave groove is formed outside the peripheral portion thereof, and an elastic seal member is provided in said concave groove to insert the open end of the resinous tank, $\alpha$ brass consisting of 15 to 38 wt. % Zn and 0.05 to 1.5 wt. % Si, and the remainder Cu, or brass containing 15 to 38 wt. % Zn, 0.05 to 1.5 wt. % Si, 0.1 to 3.0 wt. % Sn and optionally further either or both Al and Mg, not more than 2 wt. % of Al and not more than 1 wt. % of Mg being present, and the remainder Cu, are used for the tube plates.

DETAILED DESCRIPTION OF THE INVENTION

Figure 1:
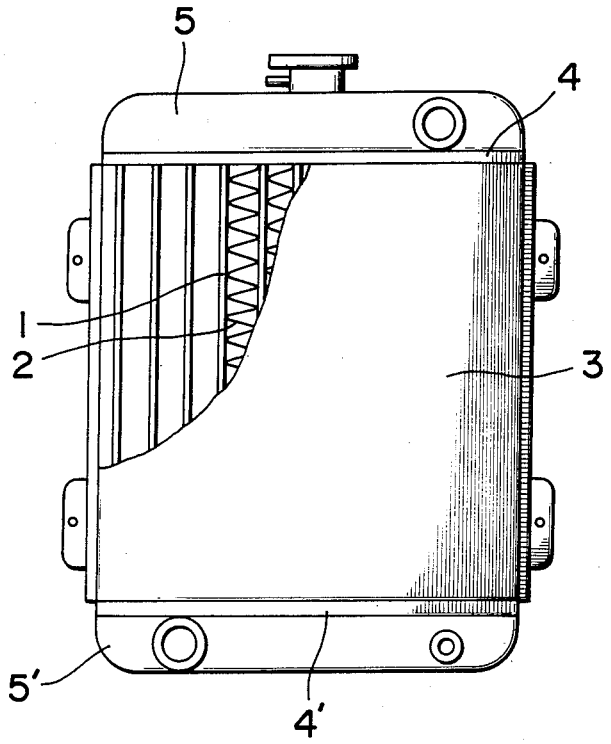
FIG. 1 is a front view showing one example of the radiator for motor cars.

Applicants have discovered that SCC of the radiator using a resinous tank that the tensile stress is a condition indispensable to SCC is the residual stress at the time of the formation of concave groove and the mechanical connection of the tank. Under the prevailing environmental conditions, the tensile stress amounts usually to more than 10 kg/mm$^2$ with $\alpha$ brass wherein Zn is present in an amount of 30 to 35 wt. %, whereas the residual stress amounts ordinarily to less than 10 kg/mm$^2$. The occurrence of SCC concentrating in the concave groove portion, following acceleration of the car, can additionally affect the mechanical connection of the resinous tank and SCC is promoted significantly due to the chinky structure peculiar to the resinous tank.

Thus, (1) Between the concave groove, in particular, the bottom portion thereof and the outside, $O_2$ concentration cell operates resulting in that the brass in the concave groove becomes base against the circumference. (2) The supply of the inhibitor in the medium becomes insufficient.

Applicants have discovered that SCC, which is a fatal defect of the radiator when using a resinous tank, can economically be prevented by adding a small amount of Si to $\alpha$ brass thereby improving the resistance for SCC to the medium. The reason why the content of Si is limited to 0.05 to 1.5 wt. % is that outside of this range SCC cannot be prevented in all cases. The effect of the addition of Si is not clear, but it is considered that Si functions to strengthen the stability of the particle boundary so that interparticle cracking is suppressed and moves to the intraparticle cracking.

Similarly to Si, Sn improved the resistance to SCC and, at the same time, it enhances the strength and also improves resistance for stress relaxation. The reason why its content is limited to 0.5 to 3.0 wt. % is that, if less is used, the improvement cannot be recognized and, if more is used, the resistance to SCC becomes inferior. Al or Mg is added to enhance the effects of Si and Sn even more and, if the amounts of these elements exceed the upper limits, the press workability becomes unsatisfactory.

The reason why the content of Zn is limited to the range aforementioned is that if under 15 wt. % is used, the resistance to SCC may be excellent, but the strength for stress relaxation, the press workability and the price are not practical, and these characteristics increase with an increase in the content of Zn. However, if the content of Zn is over 38 wt. %, excess $\beta$ phase is generated to lower the resistance to SCC and workability. From the relationship between $\beta$ phase and the Zn content, it is particularly preferable to make the alloy of $\alpha$ monophase with a Zn content of 20 to 31 wt. %.

The reason why the particle size of the crystals should be less than 80 μm is that if it becomes coarser, significant poor appearance occurs at the press process through the slipping at the particle boundary.

According to the invention, in the radiator for motor cars using a resinous tank, the brass containing Si and further Sn, Al and Mg is used for the tube plates as described above. This is effective particularly for the thinning and the lightening of the tube plate and produces also large economical savings. Thus, it is known that, for the prevention of SCC, expensive α brass and a Zn content of less than 20 wt. % may be used, but this is not suitable from the points of the mechanical properties and the price. Besides, for the tube plate, annealed material is ordinarily used in order to satisfy the workability necessary at the press process. It is possible to obtain annealed material of the fine particles by the techniques such as flash annealing, and it is more advantageous to make the particle size of crystals 10 to 60 μm.

The invention is illustrated in detail by the following examples.

Figure 2:
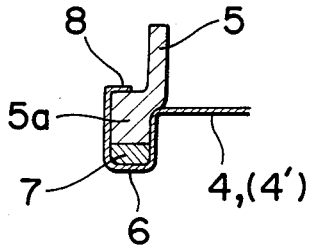
FIG. 2 is a magnified cross section of the necessary portion showing one example of the inserting portion of the resinous tank.

Using α brass plates having compositions shown in Table 1 as the tube plates, the radiators in the shape shown in FIG. 1 were assembled. Nylon 6 filled with glass short fibers was used for the resinous tank and O ring made of silicone rubber was used for the elastic seal member. As shown in FIG. 2, the flange portion of the resinous tank was inserted into the concave groove outside of the peripheral portion of the tube plate to mechanically attach it.

After a commercial anti-freeze medium for motor cars was charged into the radiators thus assembled, they were kept for 2 and 6 months in a thermostatic oven at 80° C. With regard to the radiators kept for 6 months, pressure test was carried out, which examines the existence of the leakage of fluid from the radiator by applying the pressure of 3 atm to the inside for 1 hour. Then, they were taken apart to examine the resistance of cracking. Also, the press workability was examined by visually judging the appearance after preparing the tube plate. The results are shown in Table 1.

TABLE 1

| Radiator No. | Composition of tube plate (wt %) Zn | Si | Sn | Al | Mg | Cu | Thickness of tube plate (mm) | Particle size of crystals (μm) | Press workability | cracking 2 Months | cracking 6 Months | Pressure test |
|---|---|---|---|---|---|---|---|---|---|---|---|---|
| Article of invention 1 | 34.3 | 0.06 | — | — | — | Balance | 0.6 | 60 | Good | No | No | Leakage of fluid |
| Article of invention 2 | 18.6 | 1.3 | — | — | — | " | " | 20 | " | " | " | No |
| Article of invention 3 | 30.2 | 0.53 | — | — | — | " | " | 60 | " | " | " | " |
| Article of invention 4 | 35.2 | 0.08 | — | — | — | " | " | 60 | " | " | " | |
| Article of invention 5 | 32.4 | 0.8 | — | — | — | " | " | 10 | " | " | " | " |
| Article of invention 6 | 25.0 | 1.0 | — | — | — | " | " | 80 | " | " | " | |
| Article of invention 7 | 33.2 | 0.5 | 1.0 | — | — | " | " | 25 | " | " | " | " |
| Article of invention 8 | 30.3 | 1.5 | 2.0 | — | — | " | " | 30 | " | " | " | |
| Article of invention 9 | 22.9 | 1.3 | 0.6 | — | — | " | " | " | " | " | " | " |
| Article of invention 10 | 19.9 | 0.9 | 1.8 | — | 0.7 | " | " | " | " | " | " | |
| Article of invention 11 | 20.4 | 0.9 | 2.2 | 1.5 | — | " | " | " | " | " | " | " |
| Article of invention 12 | 25.1 | 1.2 | 1.2 | 0.4 | 0.1 | " | " | 40 | " | " | " | |
| Comparative article 13 | 34.5 | — | — | — | — | " | " | 60 | " | Yes | Yes | Leakage of fluid |
| Comparative article 14 | " | — | — | — | — | " | " | 10 | " | " | " | Yes |
| Comparative article 15 | 35.1 | — | — | — | — | " | 0.8 | 60 | " | No | " | " |
| Comparative article 16 | " | — | — | — | — | " | " | 10 | " | " | No | |
| Comparative article 17 | 13.8 | — | — | — | — | " | 0.6 | 60 | " | " | " | " |
| Comparative article 18 | 34.8 | 0.01 | — | — | — | " | " | 10 | " | Yes | Yes | |
| Comparative article 19 | 35.1 | 1.80 | — | — | — | " | " | 10 | Good | Yes | Yes | Leakage of fluid Yes |
| Comparative article 20 | 30.1 | 0.96 | — | — | — | " | " | 90 | Wild texture | No | No | No |
| Comparative article 21 | 30.9 | 1.2 | 0.2 | — | — | " | " | 30 | Good | Yes | Yes | Leakage of fluid |
| Comparative article 22 | 30.6 | 1.3 | 3.5 | — | — | " | " | " | " | " | " | Yes |
| Comparative article 23 | 30.6 | 1.5 | 1.2 | 2.5 | — | " | " | " | Cracking | No | No | " |
| Comparative article 24 | " | " | " | — | 1.5 | " | " | " | " | " | " | |
| Comparative article 25 | 29.6 | 1.0 | 1.2 | — | — | " | " | 85 | Wild texture | " | " | Leakage of fluid No |

As is evident from Table 1, articles of the invention No. 1–12 have good workability without cracking. As can be seen from comparative article No. 18 and 19, if the content of Si is not within the claimed range, even though Si is present, cracking occurs regardless of the particle diameter with a thickness of plate of 0.6 mm. Moreover, in the case of comparative article No. 20 wherein the particle size of crystals is coarse, cracking does not occur, but the undesirable wild texture occurs at the time of pressing despite using α brass containing Si.

A light-in-weight and economical radiator can thus be provided by Applicants' discovery thereby effecting desirable energy conservation.

What is claimed is:

1. In a radiator for motor cars wherein fins are fitted between vertical tubes through which a heat exchanging medium is adapted to flow to form a core, and tube plates are provided at both ends of the tubes of said core to connect with a resinous tank, a concave groove is formed outside the peripheral portion of said tube plates, and an elastic seal member is provided in said concave groove to insert the open end of said resinous tank, the improvement in that said tube plates are α brass consisting of 15 to 38 wt. % Zn, 0.05 to 1.5 wt. % Si, and the remainder Cu.

2. In a heat-exchanger for motor cars wherein fins are fitted between vertical tubes through which a heat-exchanging medium is adapted to flow to form a copper core, and tube plates are provided at both ends of the tubes of said core to connect with a resinous tank, a concave groove is formed outside the peripheral portion of said tube plates, and an elastic seal member is provided in said concave groove to insert the open end of said resinous tank, the improvement in that said tube plates are brass consisting of 15 to 38 wt. % Zn, 0.5 to 3.0 wt. % Sn, 0.05 to 1.5 wt. % Si, and the remainder Cu.

3. In a heat-exchanger for motor cars wherein fins are fitted between vertical tubes through which a heat-exchanging medium is adapted to flow to form a copper core, and tube plates are provided at both ends of the tubes of said said core to connect with a resinous tank, a concave groove is formed outside the peripheral portion of said tube plates, and an elastic seal member is provided in said concave groove to insert the open end of said resinous tank, the improvement in that said tube plates are brass consisting of 15 to 38 wt. % Zn, 0.5 to 3.0 wt. % Sn, 0.05 to 1.5 wt. % Si, and Al in an mount of not more than 2.0 wt. % or Mg in an amount of not more than 1.0 wt. %, or mixtures of both Al and Mg in the stated amounts, and the remainder Cu.

4. The radiator for motor cars according to claim 1 wherein in said tube plates the particle size of crystals is not more than 80 μm.

5. The heat-exchanger according to claim 3, wherein said brass contains Al in an amount of not more than 2.0 wt. %.

6. The heat-exchanger according to claim 3, wherein said brass contains mg in an amount of not more than 1.0 wt. %.

7. The heat-exchanger according to claim 3, wherein said brass contains a mixture of both Al and Mg, the amount of Al being not more than 2.0 wt. % and the amount of Mg being not more than 1.0 wt. %.

* * * * *